United States Patent [19]

Swisher, Jr. et al.

[11] 4,293,228

[45] Oct. 6, 1981

[54] DRUM FOR AN ASPHALT MIXING APPARATUS

[75] Inventors: George W. Swisher, Jr., Oklahoma City; David L. Garbelman, Edmond; Arthur G. Shaw, Mustang, all of Okla.

[73] Assignee: CMI Corporation, Oklahoma City, Okla.

[21] Appl. No.: 89,212

[22] Filed: Oct. 29, 1979

[51] Int. Cl.[3] ..... B28C 5/20

[52] U.S. Cl. ..... 366/25; 366/40; 366/57; 432/110; 432/118

[58] Field of Search ..... 366/12, 25, 34, 37, 366/57, 58, 59, 180, 228, 40; 34/109, 216, 217; 432/110, 118

[56] References Cited

U.S. PATENT DOCUMENTS 4,060,042 11/1977 Baraldi et al. ..... 432/110 X 4,174,181 11/1979 Garbelman et al. ..... 366/25 X

FOREIGN PATENT DOCUMENTS 399407 10/1942 Italy ..... 366/59

*Primary Examiner*—Philip R. Coe

*Attorney, Agent, or Firm*—Dunlap, Codding & McCarthy

[57] ABSTRACT

Annular lands are mounted on the inner periphery of the tubular shell of a drum for an asphalt mixing apparatus of the type wherein the drum is disposed on a slant and rotated so that flighting arranged about the inner periphery of the drum lifts and drops aggregate and asphalt across the drum to transport the aggregate and asphalt toward the lower end of the drum. Portions of the flighting are mounted in the inner periphery of the shell and portions are mounted on the annular lands. The lands reduce the inside diameter of the drum in selected regions thereof to establish differing advance rates of aggregate and asphalt through the drum in different regions thereof so as to selectively vary the density of veils of asphalt and aggregate across the drum with axial location within the drum.

9 Claims, 12 Drawing Figures

DRUM FOR AN ASPHALT MIXING APPARATUS

CROSS REFERENCE TO RELATED APPLICATIONS

The subject matter of this application is related to the subject matter disclosed in U.S. patent application entitled "Method and Apparatus for Establishing Aggregate Cascade Zones in an Apparatus for Producing Hot Mix Asphalt", Ser. No. 896,512, filed Apr. 17, 1978, and assigned to the assignee of the present invention.

BACKGROUND OF THE INVENTION

1. Field of the Invention

The present invention relates generally to asphalt mixing apparatus and, more particularly, but not by way of limitation, to asphalt mixing apparatus which may utilize particulated, previously laid asphalt mix in the preparation of fresh hot mix asphalt.

2. Background of the Invention

While hot mix asphalt is a necessary commodity in an industrial society, its use for such purposes as paving roadways, parking lots and the like, has not always been without excessive environmental and energy costs. Asphalt is produced from aggregate and asphaltic oil which are heated and mixed in a rotating drum and heating of the aggregate is accomplished by means of a burner at the input end of the drum, such burner producing a flame in portions of the drum near the input end of the drum to dry the aggregate prior to mixing the aggregate with the asphaltic oil. It is common to draw excess air through the drum by means of a fan or the like and such air can entrain fine particles in the aggregate so that the fines are discharged into the atmosphere as the air is discharged from the drum. Sources of excessive energy costs are inefficiency in heat transfer from the flame to the aggregate and burning of the asphaltic oil by the flame.

The drum of the asphalt mixing apparatus is disposed on a slant and flighting is mounted about the inner periphery of the drum to lift and drop the aggregate and asphalt across the interior of the drum, to form a veil of falling material across the drum. This veiling serves several purposes. The aggregate is dropped through the flame to enhance heat transfer from the flame to the aggregate and the lifting and dropping of aggregate while introducing asphaltic oil into the drum serves to mix the aggregate and oil to form the asphalt. Moreover, the veiling also advances the aggregate and asphalt toward the lower, or discharge, end of the drum. That is, since the drum is disposed on a slant, the flighting drops aggregate and asphalt forwardly of the point where the asphalt or aggregate was picked up by the flighting.

It has been recognized that the interplay of heated air passing through the drum and the veiling of material across the drum can be utilized to reduce the problem of fines being discharged into the atmosphere and to increase the efficiency of fuel utilized to heat the aggregate from which the asphalt is made. Thus, in U.S. Pat. No. 3,940,120, issued Feb. 24, 1976 to Miller, circumferential baffle rings are disposed between rows of flighting to reduce the discharge of fines. The baffle rings have the effect of bunching up asphalt or aggregate in the vicinity of the rings and of deflecting the air stream through the drum, such air stream entraining fines, into the veil of aggregate or asphalt across the drum. Similarly, the aforementioned U.S. patent application, Ser. No. 896,512, teaches that fines in the discharge from an asphalt mixing apparatus can be reduced and heating of aggregate can be made more efficient by establishing zones of different veil density in different parts of the drum.

While the teachings of the above cited patent and patent application have made valuable advances in the state of the art of asphalt production, it is important that improvements in fines discharge reduction and fuel efficiency continue. Concern for the environment can only result in more stringent governmental regulations of fines discharge and the need to conserve fuel stocks is well known.

SUMMARY OF THE INVENTION

The present invention exploits the above described transport mechanism provided by flighting on the inner periphery of the drum of an asphalt mixing apparatus to economically achieve an effective means of tailoring the veil density in different parts of the drum so as to increase the efficiency of fuel utilization in the production of hot mix asphalt and to reduce the discharge of fines from the drum. In the steady state operation of an asphalt mixing apparatus, the rate at which the solid components of asphalt, that is, the aggregate, is transported through the drum is, of course, constant throughout the drum. That is, the amount of material entering a region of the drum is the same as the amount leaving such region. However, the average speed, or advance rate, at which material advances through the drum need not be constant therealong. Rather, the advance rate is subject to variation by the form and placement of the flighting used to effectuate the transport of solids through the drum. Since the transport rate remains constant, the effect of such variation in advance rate will generally result in a compensating variation in veil density along the drum. Thus, by varying the advance rate of aggregate and asphalt toward the discharge end of the drum, it becomes possible to intersperse heavy veil density regions in the drum with relatively lighter veil density regions. For example, a heavy veil density region can be formed about the terminal portions of the flame used to dry aggregate to enhance thermal contact between the aggregate and the flame and a lighter veil density can be formed about portions of the flame near the input end of the drum to enhance combustion of the fuel used to produce the flame. Similarly, a heavy veil density region can be formed in any desired region of the drum for the purpose of trapping fines which might otherwise be discharged from the drum.

In the present invention, the advance rate of solid material through the drum of the asphalt mixing apparatus is varied by varying the inner diameter of the drum which supports the flights utilized to transport aggregate and asphalt toward the discharge end of the drum. Since such transport is the result of lifting the aggregate along a spiral path, as seen from a point outside the asphalt mixing apparatus, and then dropping the asphalt across the interior of the drum, the average advance rate of asphalt and aggregate through the drum is determined by the pitch of the spiral path. This pitch, in turn, is directly proportional to the diameter of the drum so that, by varying the diameter of the drum, the pitch of the spiral path and, accordingly, the advance rate and veil density of the aggregate and asphalt can be adjusted along the drum.

A particularly advantageous result of tailoring the veil density along the length of the drum by varying the advance rate of aggregate and asphalt as in the present invention is the minimizing of thermal short circuits along the inner periphery of the drum. A problem experienced with drum type asphalt mixers in the past has been the passage of streams of air through channels in the veil of asphalt and aggregate near the periphery of the drum and said streams carry away a large portion of the heat deposited in the drum via the flame introduced into the input end thereof. Such streams also exacerbate the problem of the discharge of fines by the asphalt mixing apparatus into the atmosphere. By reducing the diameter of the dryer in selected portions of the drum, the veil of falling material in adjacent portions of the drum can be caused to extend across the reduced diameter portion to minimize such thermal short circuits.

An object of the present invention is to increase the fuel efficiency of an apparatus for making hot mix asphalt.

Another object of the present invention is to reduce the discharge of fines from an asphalt mixing apparatus.

Yet another object of the present invention is to provide an economical means for varying the veil density of aggregate and asphalt across the drum of an asphalt mixing apparatus so as to tailor the veil density in different portions of the drum to tasks being carried out in such portions.

Still a further object of the present invention is to minimize the formation of channels through the veil of aggregate and asphalt falling across the drum.

Other objects, advantages and features of the present invention will become clear from the following detailed description of the preferred embodiments of the invention when read in conjunction with the drawings and appended claims.

BRIEF DESCRIPTION OF THE DRAWINGS

FIG. 8 is a partial transverse cross-section of the drum of FIG. 4 taken along line 8—8 of FIG. 4.

FIG. 9 is a longitudinal cross-section of a modification of the drum shown in FIG. 4.

Figure 1:
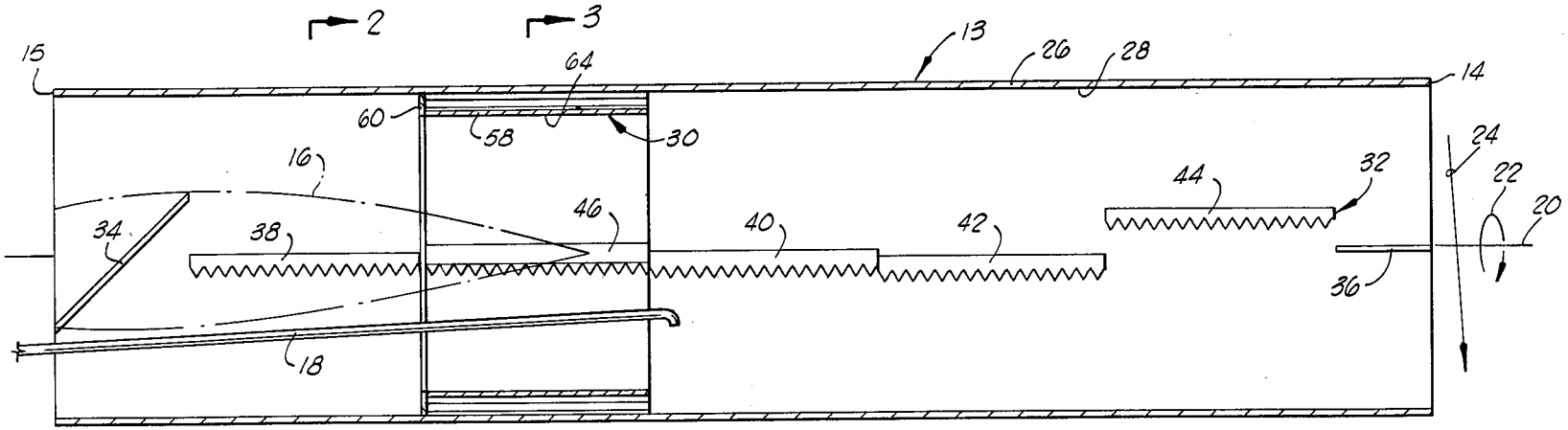
FIG. 1 is a longitudinal cross-section of one preferred embodiment of a drum, constructed in accordance with the present invention, for an asphalt mixing apparatus.
Figure 3:
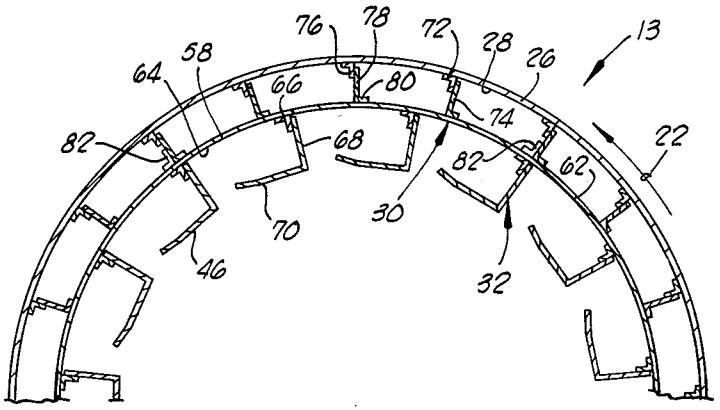
FIG. 3 is a partial transverse cross-section of the drum of FIG. 1 taken along line 3—3 of FIG. 1.
Figure 2:
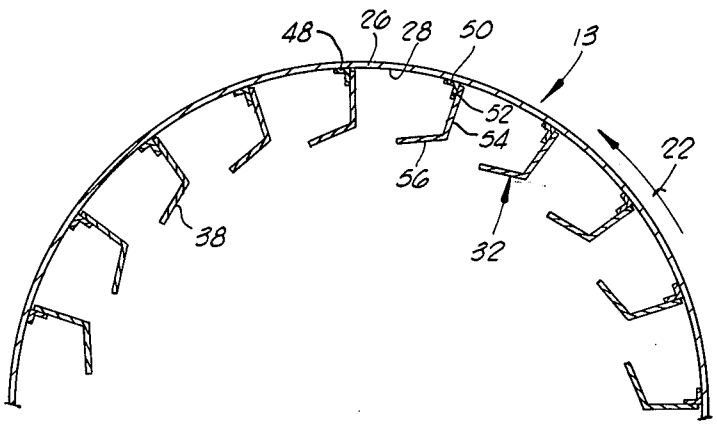
FIG. 2 is a partial transverse cross-section of the drum of FIG. 1 taken along the line 2—2 of FIG. 1.

DESCRIPTION OF FIGS. 1, 2 and 3

Referring now to the drawings in general and to FIGS. 1, 2 and 3 in particular, shown therein and designated by the general reference numeral 13 is a drum of an asphalt mixing apparatus constructed in accordance with the present invention. The drum 13 has an input end 15 and means are provided in an asphalt mixing apparatus incorporating the drum 13 for introducing virgin aggregate into the input end 15 of the drum 13. The drum 13 has an output end 14 and means are similarly provided in an asphalt mixing apparatus incorporating the drum 13 for receiving asphalt mixed in the drum 13 therefrom. Such asphalt mixing apparatus incorporating the drum 13 will further comprise means for introducing a flame, shown in phantom lines and designated by the numeral 16 in FIG. 1, into the input end of the drum 13; means for introducing asphaltic oil through pipe 18 into a medial portion of the drum 13; and means for drawing secondary air through the drum 13. The asphalt mixing apparatus supports the drum 13 on a slant with the input end 15 of the drum 13 higher than the discharge end 14 of the drum 13 and rotates the drum 13 about the axis 20 thereof in the direction shown by the directional arrow designated 22 in FIGS. 1, 2 and 3. Because of the disposition of the axis 20 along a slant, the downward direction will generally make an angle with the axis 20 and the downward direction has been indicated by the directional arrow designated 24 in FIG. 1. An example of the type of asphalt mixing apparatus which might include the drum 13 is an apparatus such as that disclosed in the aforementioned U.S. patent application Ser. No. 896,512, which is herein incorporated by reference to the extent that the teachings therein are herein applicable.

The drum 13 comprises a cylindrical shell 26 having an axis coinciding with the axis 20 of the drum 13 and portions of the inner periphery 28 of the shell 26 form a major portion of the inner periphery of the drum 13. An annular land, generally designated 30 and mounted on the inner periphery 28 of the shell 26 as will be described below, forms the remainder of the inner periphery of the drum 13 so that the inner periphery of the drum 13 has a relatively small diameter portion interposed between two relatively larger diameter portions. Flighting, generally designated 32 in the drawings, is mounted on the inner periphery of the drum 13 including portions of the inner periphery of the drum 13 formed by the annular land 30. (For clarity of illustration, only a portion of the flighting 32 has been shown in FIG. 1. FIGS. 2 and 3 have been included to show the general arrangement of the flighting 32.) Adjacent the input end 15 of the drum 13, a plurality of plates 34 are mounted at an angle with the axis 20 on the inner periphery 28 of the shell 26 so that the plates 34 receive aggregate introduced into the input end 15 of the drum 13 and force the aggregate into portions of the flighting 32 disposed between the annular land 30 and the input end 15 of the drum 13. (For clarity of illustration, only one of the plates 34 has been shown in the drawings.) Adjacent the output end 14 of the drum 13, a plurality of paddles 36 can be mounted on the inner periphery 28 of the shell 26 to tumble asphalt formed in the drum 13 so as to enhance the discharge of the asphalt from the discharge end 14 of the drum 13. (Only one of the paddles 36 has been shown in FIG. 1.)

As has been indicated in FIGS. 1, 2 and 3, the flighting 32 is preferably arranged in a plurality of circumferentially extending rows of individual flights which are symmetrically spaced about the inner periphery of the drum 13. In particular, the flighting 32 includes four substantially indentical rows of flights on the inner periphery 28 of the shell 26, such rows comprising a row of flights 38 disposed between the plates 34 and the annular land 30 and three rows of flights 40, 42 and 44 disposed in serial fashion between the annular land 30 and the paddles 36 at the discharge end 14 of the drum 13. For a purpose to be discussed below, the flights 38 and the flights 40 abut opposite sides of the annular land 30. The flighting 32 further comprises a row of flights 46 mounted on the annular land 30 and the flights 46 extend substantially the length of the land 30 as has been indicated in FIG. 1. (For clarity of illustration, only one member of each of the rows of flights 38–46 has been shown in FIG. 1 and only one of the flights 38 and one of the flights 46 have been numerically designated in FIGS. 2 and 3 respectively.)

FIG. 2, wherein is shown a partial transverse cross-section of the drum 13 through the row of flights 38, has been included to show the construction of the flights 38 and the manner in which the flights 38 are mounted on the inner periphery 28 of the shell 26. For this purpose, the drum 13 is provided with a plurality of flight mounting members 48 which are symmetrically spaced about the inner periphery 28 of the shell 26 and which extend substantially parallel to the axis 20 of the drum 13. (For clarity of illustration, only one flight mounting member has been numerically designated in FIG. 2.) Each flight mounting member 48 is a length of angle iron having one leg 50 welded flush to the inner periphery 28 of the shell 26 and having the other leg 52 thereof extending substantially radially toward the axis 20 of the drum 13. (For clarity of illustration, the legs of only one flight mounting member 48 have been numerically designated in FIG. 2.) Each of the flights 38 is constructed of sheet metal which is bent along a longitudinal line so as to form the flight 38 into a substantially rectangular base forming portion 54 with a substantially rectangular bucket forming portion 56 extending from one side of the base forming portion 54 so that the flight 38 has a generally L-shaped cross-section as has been shown in FIG. 2. (The portions 54 and 56 of only one flight 38 have been numerically designated in FIG. 2.) A plurality of apertures (not shown) are formed through the base forming portion 54 of each flight 38 along the edge of the base forming portion 54 opposite the bucket forming portion 56. Similar apertures (not shown) are formed in the leg 52 of each of the flight mounting members 48 and the flights 38 are mounted on the inner periphery 28 of the shell 26 by bolting the base forming portion of each flight 38 to the leg 52 of one of the flight mounting members 48 via bolts (not shown) which pass through the apertures in the legs 52 and the base forming portions 54. The flights 38 are disposed such that the bucket forming portions 56 thereof extend generally in the direction 22 in which the drum 13 rotates. As is known in the art, the edges of the bucket forming portions 56 of the flights 38 opposite the base forming portions 54 of the flights 38 can be serrated to provide a more even distribution of the veil of asphalt across the drum 13 during operation of an asphalt mixing apparatus incorporating the drum 13. Similarly, slots (not shown) can be formed in the base forming portions 54 of selected flights 38 as has been disclosed in the aforementioned U.S. patent application, Ser. No. 896,512. (Slots can also be formed in portions of other flights 40–46 corresponding to the portions 54 of the flights 38 and in such corresponding portions of selected flights of embodiments of the present invention to be discussed below.) The flights 40, 42 and 44 have the same general form as the flights 38 and are mounted on the inner periphery 28 of the shell 26 in a manner identical to the mounting of the flights 38 thereon. The mounting of the flights 46 on the annular land 30 will be discussed below.

Referring once again to FIG. 1 and referring also to FIG. 3, shown therein is the construction and mounting of the annular land 30 on the inner periphery 28 of the shell 26. The annular land 30 comprises a tubular member 58 having a smaller outside diameter than the inside diameter of the shell 26 and, as has been indicated in FIGS. 1 and 3 and as will be described below, the tubular member 58 is disposed concentrically with the shell 26. The annular land 30 further comprises a ring 60, having an outside diameter substantially equal to the inside diameter of the shell 26 and an inside diameter substantially equal to the inside diameter of the tubular member 58. The ring 60 is mounted in the drum 13 so as to close the spacing between the tubular member 58 and the shell 26 at the end of the annular land 30 nearest the input end 15 of the drum 13. Thus, the inner periphery 64 of the tubular member 58 forms a portion of the inner periphery of the drum 13.

The flights 46 are generally similar to the flights 38–44 and the flights 46 are mounted on the inner periphery 64 of the tubular member 58 in the same manner that the flights 38–44 are mounted on the inner periphery 28 of the shell 26. That is, as shown in FIG. 3, a plurality of flight mounting members 66, which are identical to the flight mounting members 48, are attached to the inner periphery 64 of the tubular member 58 in the same manner that the flight mounting members 48 are attached to the inner periphery 28 of the shell 26. (For clarity of illustration, only one of the flight mounting members 66 has been numerically designated in FIG. 3.) The flights 46 each comprise a rectangular base forming portion 68 which is bolted near one edge thereof to one of the flight mounting members 66 and a bucket forming portion 70 which extends from the opposite edge of the base forming portion 68 generally in the direction 22 in which the drum 13 is rotated. As in the case of the flights 38–44, the distal edges of the bucket forming portions 70 of the flights 46 can be serrated and slots can be formed in the base forming portions 68 of selected flights 46.

As will be clear to those skilled in the art, the closure of the annular spacing between the tubular member 58 and the shell 26 by the ring 60, such that the inner periphery of the drum 13 is formed partially by a portion of the inner periphery 28 of the shell 26 and partially by the inner periphery 64 of the tubular member 58, will result in portions of the shell 26 about the annular land 30 being cooler than nearby portions of the shell 26 and cooler than the tubular member 58 during operation of the asphalt mixing apparatus incorporating the drum 13 so that different portions of the drum are subjected to different degrees of heating each time the asphalt mixing apparatus is operated. In order to prevent resulting differing degrees of thermal expansion of portions of the shell 26 and of resulting differing degrees of thermal expansion between portions of the shell 26 and the tubular member 58 from causing stresses in structural members utilized to mount the annular land 30 within the shell 26, such stresses possibly damaging the drum 13, the annular land 30 is mounted in a novel manner which eliminates such stresses and which will now be described with particular reference to FIG. 3.

A plurality of mounting members 72, identical to the flight mounting members 48 and 66, are welded to the inner periphery 28 of the shell 26 in a circumferential row about portions of the drum 13 where the annular land 30 is to be located and the lengths of the mounting members 72 each extend substantially parallel to the axis 20 of the drum 13 for a distance substantially equal to the length of the tubular member 58. To each mounting member 72 is bolted a stand-off 74, having a length substantially equal to the length of the tubular member 58 and having a generally L-shaped cross section, and apertures (not shown) are formed through radially extending legs 76 of the mounting members 72 and one leg 78 of each of the stand-offs 74 for this purpose. Each stand-off 74 is mounted on a mounting member 72 such that the other leg 80 of each stand-off 74 extends in a direction from the leg 78 thereof in a direction opposed to the direction 22 in which the drum 13 rotates. (For clarity of illustration, only one mounting member 72, one stand-off 74, one leg 76, one leg 78, and one leg 80 have been numerically designated in FIG. 2.) The widths of the legs 78 of the stand-offs 74 are selected such that the legs 80 form a broken cylindrical surface which is centered on the axis 20 of the drum 13 and which has a diameter equal to the diameter of the outer periphery 62 of the tubular member 58. The tubular member 58 is then mounted on the drum 13 by sliding the tubular member 58 into the cylindrical surface about the axis 20 of the drum 13 defined by the plurality of stand-offs 74 so that the tubular member 58 is positioned concentrically with the shell 26 by the engagement of the outer periphery 62 of the tubular member 58 with the legs 80 of the stand-offs 74. In order to prevent relative rotation of the shell 26 and the tubular member 58, a plurality of stops 82 are welded to the outer periphery 62 of the tubular member 58 to engage selected stand-offs 74. Specifically, the stops 82 engage the sides of the legs 78 of the stand-offs 74 opposite the sides thereof from which the legs 80 extend. Accordingly, since any relative rotation of the tubular member 58 relative to the shell 26, such relative rotation arising from resistance to rotation of the tubular member 58 caused by the lifting of aggregate by the flights 46, would be in a direction opposite the direction 22 in which the drum 13 rotates, the stops 82 will be forced against the flat sides of the legs 78 of the stand-offs 74, upon the initial use of the drum 13, by the weight of aggregate lifted and dropped by the flights 46 so that the stand-offs 74 and stops 82 transmit the rotation of the drum 13 to the flights 46. The end of the tubular member 58 nearest the discharge end 14 of the drum 13 is positioned in the drum 13 by engagement of such end with the flights 40 which, as has been noted above, abut the annular land 30. The ring 60 is conveniently mounted in the drum 13 by dividing the ring 60 into sections and inserting the sections into a gap left between the mounting members 72 and the flight mounting members 48 and flights 38 followed by welding the sections of the ring 60 into a complete ring. The ring 60 engages the ends of the flights 38 and the flight mounting members 48 nearest the discharge end 14 of the drum 13 to axially position the end of the annular land 30 nearest the input end 15 of the drum 13.

Operation of FIGS. 1, 2 and 3

In the operation of an asphalt mixing apparatus incorporating the drum 13, the drum 13 is disposed on a slant with the input end 15 thereof higher than the discharge end 14 thereof as has been indicated by the direction arrow 24 which, as noted above, points out the downward direction during the operation of the asphalt mixing apparatus. The drum 13 is rotated in the direction 22 about the axis 20 of the drum 13 while the flame 16 and aggregate are introduced into the input end 15 of the drum 13 and asphaltic oil is introduced into the medial portion of the drum 13 via the pipe 18. The apparatus incorporating the drum 13 will have a fan or the like for drawing combustion products from the flame 16 and air from the discharge end 14 of the drum 13 so that a flow of heated air will be established through the drum 13.

As the drum 13 rotates, aggregate is forced into the flights 38 by the angled plates 34 and the flights 38 lift aggregate along the portion of the inner periphery 28 of the shell 26 where the flights 38 are disposed. Such aggregate dribbles from the flights 38 as the flights 38 move along upper portions of the drum 13 to establish a veil of falling aggregate across the interior of the drum 13 so that aggregate is passed through the flame 16 for drying the aggregate. The veiling of the aggregate also results in the transport of the aggregate toward the discharge end 14 of the drum 13 because of the disposition of the drum 13 on a slant relative to the horizontal. That is, aggregate is lifted from the floor of the drum 13 by the flights 38 and, because of the slant along which the drum 13 is disposed, such aggregate is dropped forwardly of the position from which the aggregate is lifted. Thus, the veiling of aggregate by the flights 38 establishes a transport, referred to herein as a veil transport, through the portion of the drum 13 where the flights 38 are mounted such that the aggregate is moved toward the discharge end 14 of the drum 13. The flights 46 mounted on the annular land 30 similarly establish a veil transport through portions of the drum 13 where the annular land 30 is located so that aggregate is moved from the input end 15 of the drum 13 to the region of the drum 13 where the flights 40 are mounted and where oil is discharged into the drum 13 via the pipe 18. The oil mixes with the aggregate and the flights 40 lift and drop oil coated aggregate to mix the oil and aggregate into asphalt and to form a veil transport of the asphalt so formed toward the discharge end 14 of the drum 13. The flights 42 and 44 continue the mixing process and continue the veil transport of asphalt towards the discharge end 14 of the drum 13 and the paddles 36 force the asphalt into a suitable discharge chute (not shown) at the discharge end 14 of the drum 13.

The present invention exploits the difference between transport rate of aggregate and asphalt through the drum 13 and advance rate through portions of the drum 13 to make more efficient utilization of fuel consumed in producing the flame 16. In a steady state operation of an asphalt mixing apparatus, the quantity of aggregate passing through any cross section of the drum 13 per unit time; that is, the transport rate of aggregate through the drum 13 will, of necessity, be constant. That is, the rate at which aggregate enters a region of the drum 13 will, in the steady state, equal the rate at which aggregate leaves such region. However, the advance rate; that is, the average speed with which aggregate is moved through a region of the drum 13, need not be constant along the length of the drum 13. Rather, the advance rate is determined by the mechanism by which the aggregate is moved through such region and, where such mechanism is the above-described veiling of aggregate across the drum, aggregate will build up on the floor of the drum and will increase the density of the veil of falling material to the point that the advance rate and the density of the veil will result in the constant transport rate of aggregate through the drum. That is, in regions of reduced advance rate, a compensating, higher veil density is formed to maintain the transport rate of aggregate through the drum 13 at a constant value. In the drum 13, the advance rate in that portion of the drum 13 where the annular land 30 is disposed is reduced by reducing the average height that aggregate is lifted to form the veil of aggregate across the interior of the drum 13. For example, the maximum height a particle of aggregate can be lifted by the flights 46 is substantially equal to the diameter of the inner periphery 64 of the annular land 30 while the maximum height that aggregate can be lifted in other portions of the drum 13 is substantially equal to the larger diameter of the inner periphery 28 of the shell 26. The result, then, is that the advance rate of aggregate through portions of the drum 13 mounting the annular land 30 is reduced so that a correspondingly higher veil density is formed in such portion of the drum 13.

The formation of the higher veil density in the portion of the drum 13 where the annular land 30 is located has several advantageous results. The relatively heavy veil density formed within the annular land 30 results in good thermal contact between terminal portions of the flame 16 and the aggregate falling across the drum 13 within the annular land 30 to enhance heat transfer from the flame 16 to the aggregate. On the other hand, the relatively lighter veil formed by the flights 38 results in little interference with the combustion of fuel in portions of the flame 16 nearer the input end 15 of the drum 13 so that both combustion of the fuel and the transfer of heat from the combustion products to the aggregate are enhanced. Moreover, the formation of a heavier veil density within the annular land 30 reduces the streaming of air through channels in the veil of falling aggregate to form thermal short circuits which can carry heat from the flame along the inner periphery of the drum 13 to reduce the efficiency of fuel consumed to produce the flame. That is, the lighter density veil formed by the flights 38 and 40 will extend substantially entirely across the openings of the annular land 30 toward the input end 15 of the drum 13 and output end 14 thereof respectively so that air, streaming through the drum 13, must pass at least through the relatively lighter veils formed by the flights 38 and 40 in order to move to the output end 14 of the drum 13.

Description of FIGS. 4 through 8

Referring now to FIGS. 4 through 8, shown therein and designated by the general reference numeral **13*a* is a second embodiment of an asphalt mixing apparatus drum constructed in accordance with the present invention. The drum 13*a* is particularly suited for the production of fresh hot mix asphalt from virgin aggregate, introduced into the input end 15 of the drum 13*a*, and particulated, previously laid asphalt mix introduced into a medial portion of the drum 13*a* between the annular land 30 and the discharge end 14 of the drum 13*a*. For the purpose of introducing the particulated, previously laid asphalt into the drum 13*a*, a plurality of ports 84 are formed through a medial portion of the shell 26*a* and the asphalt mixing apparatus incorporating the drum 13*a* includes a shroud 86, indicated in phantom lines in FIG. 4, disposed about the ports 84 and into which the particulated, previously laid asphalt can be poured by any suitable means. The ports 86 are overlaid with covers 88 which are mounted via hinges 90, 92 on the inner periphery 28 of the shell 26*a* so that each port 84 is open for the entry of particulated, previously laid asphalt into the drum 13*a* at such times that such port is located near the top of the drum 13*a*. The weight of each cover 88 forces such cover 88 against the periphery 28 of the shell 28*a* at such times that the port 84 overlaid by such cover is located near the bottom of the drum 13*a* and plates 94 are mounted on the covers 88 and extend inwardly toward the axis 20 of the drum 13*a*. The plates 94 are angled with respect to the axis 20 of the drum 13*a* so that the plates 94 engage aggregate and particulated, previously laid asphalt to force the aggregate and particulated, previously laid asphalt toward the discharge end 14 of the drum 13*a* in the manner that the plates 34 force virgin aggregate toward the discharge end 14 of the drum 13*a*. (For clarity of illustration, only one cover 88, one hinge 90, one hinge 92 and one plate 94** have been shown in the drawings.)

The drum **13*a* further differs from the drum 13 in that a second annular land 96 is mounted medially of portions of the inner periphery 28 of the shell 26*a* disposed between the ports 84 and the discharge end 14 of the drum 13*a* and in the construction of the flighting mounted on the inner periphery of the drum 13*a*. The annular land 96 is identical to the annular land 30 and the tubular member 98 thereof is positioned concentrically with the shell 26*a* in the same manner that the tubular member 58 of the annular land 30 is positioned concentrically with the shell 26*a*. That is, a plurality of stand-offs 100 (FIG. 8) are mounted on the inner periphery 28 of the shell 26*a*, in the same manner that the stand-offs 74 are mounted thereon, and extended a selected distance toward the axis of the drum 13*a* to engage the outer periphery 102 of the tubular member 98 of the annular land 96 to concentrically position the tubular member 98 with the shell 26*a***.

Referring once again to FIG. 4, the flighting in the drum **13*a* comprises: a circumferential row of composite flights generally designated 104 which abut the end of the annular land 30 nearest the input end 15 of the drum 13*a* and extend substantially to the plates 34; a circumferential row of composite flights 106 which abut the end of the annular land 96 nearest the input end 15 of the drum 13*a* and extend to a position near the ports 84; a row of composite flights 108 on the inner periphery 64 of the tubular member 58 of the annular land 30, the flights 108 extending substantially the length of the tubular member 58; and a row of composite flights 110 on the inner periphery 112 of the tubular member 98 of the annular land 96, the flights 110 similarly extending substantially the length of the tubular member 98. (For clarity of illustration, only one member of each row of flights 104–110 and only one plate 34 have been shown in FIG. 4 and only one flight 104–110 and portions thereof have been numerically designated in FIGS. 5–8.) As will be noted from FIG. 4, no flights are mounted on the inner periphery 28 of the shell 26*a* so as to engage the ends of the annular lands 30 and 98 nearest the discharge end 14 of the drum 13*a* and prevent movement of the tubular members 58 and 98 thereof toward the discharge end 14 of the drum 13 in the manner that the flights 40 prevent such movement of the tubular member 58 of the drum 13. In order to axially position the annular lands 30 and 96 in the drum 13***a*, suitable stops (not shown) are mounted on the inner periphery 28 of the shell 26*a* to engage the ends of the annular lands 30 and 96 nearest the discharge end 14 of the drum 13*a* and the annular lands 30 and 96 are axially positioned by the stops and by the rows of flights 104 and 106 respectively.

Figure 4:
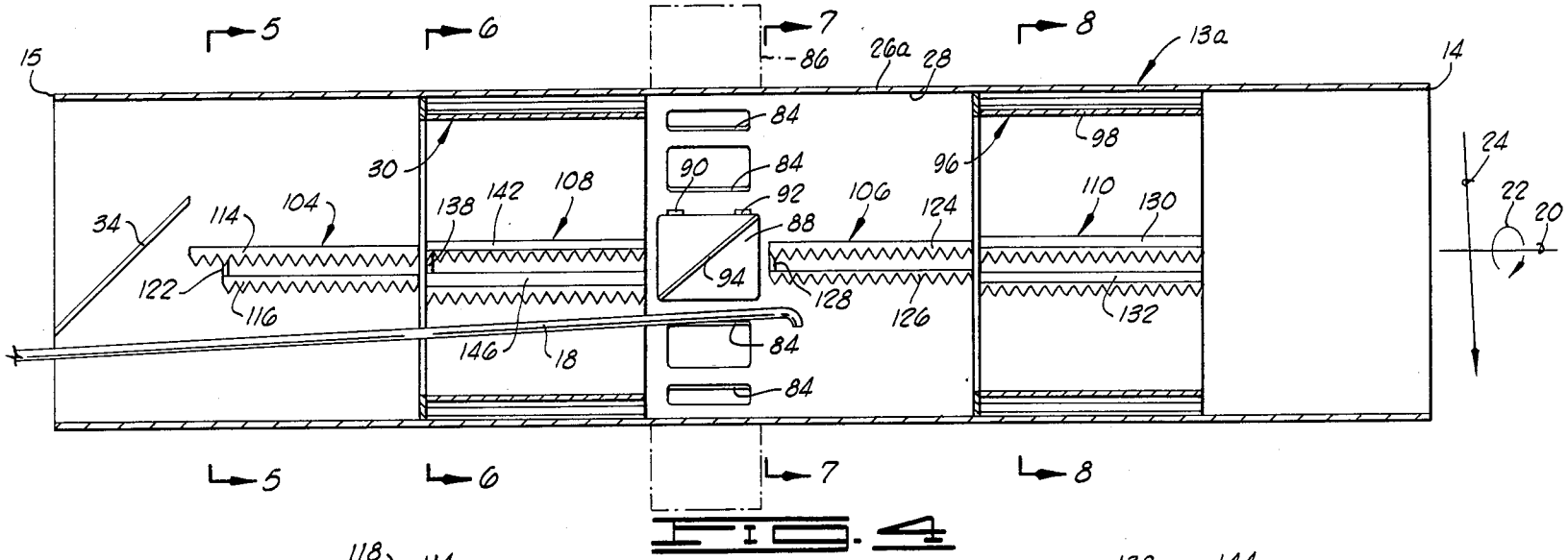
FIG. 4 is a longitudinal cross-section of a second embodiment of a drum, constructed in accordance with the present invention, for an asphalt mixing apparatus.
Figure 5:
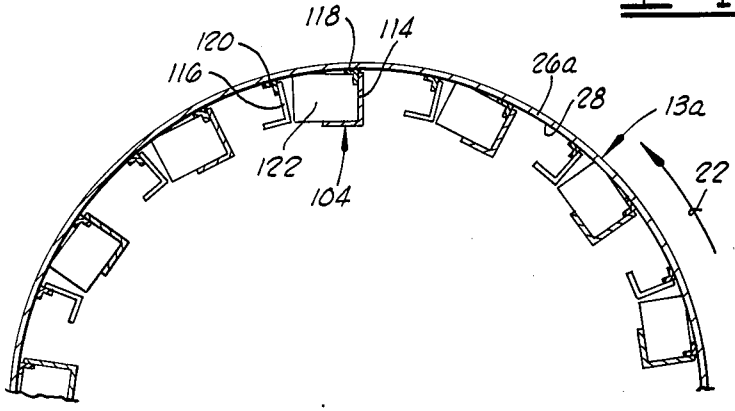
FIG. 5 is a partial transverse cross-section of the drum of FIG. 4 taken along line 5—5 of FIG. 4.
Figure 5:
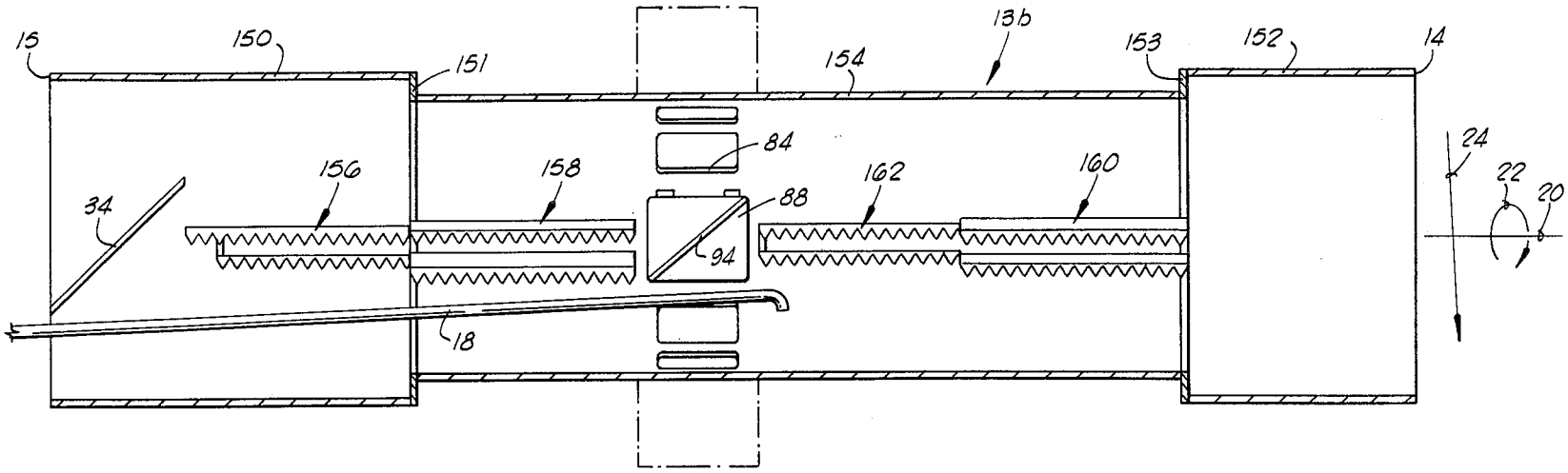
Figure 6:
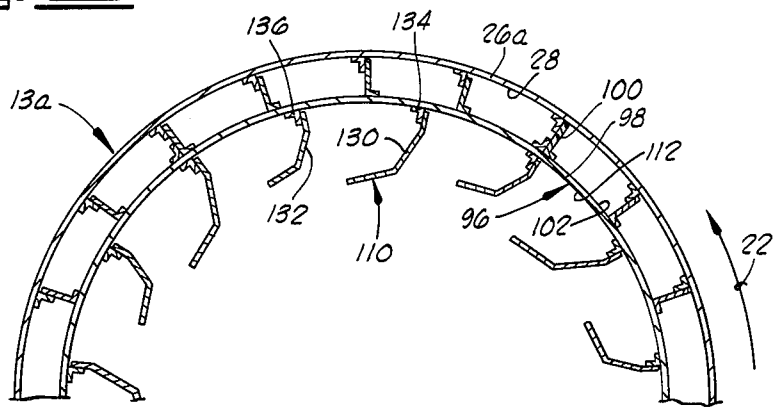

FIGS. 5 through 8 have been included to show the preferred form of the flights 104, 108, 106 and 110 respectively in the drum 13*a*. As shown in FIG. 5, each of the composite flights 104 comprises two L-shaped members 114 and 116 which are mounted on the inner periphery 28 of the shell 26*a* with one leg of each member 114, 116 extending substantially radially from the periphery 28 and, at the distal end of such one leg, the other leg of each member 114, 116 extending generally parallel to the inner periphery 28 of the shell 26*a* in the direction 22 in which the drum 13*a* is rotated. The members 114 are symmetrically spaced about the periphery 28 and each member 116 is positioned substantially halfway between two members 116. The member 114 has a greater radial extent toward the center of the drum 13*a* than the member 116 and, as shown in FIG. 4, the member 114 extends a greater distance parallel to the axis 20 of the drum 13*a* than does the member 116. Such shaping of the flights 104 has been found to provide a suitable veil for heating and drying virgin aggregate. The members 114, 116 are mounted on the shell 26*a* in the manner previously described for the flights of the drum 13 and suitable flight mounting members 118 and 120, for mounting the members 114 and 116 respectively, are welded to the inner periphery 28 of the shell 26*a* for this purpose. The distal edges of the legs of the members 114 and 116 substantially parallel to the shell 26*a* can be serrated in the usual manner (FIG. 4) and dams 122 can be welded between the members 114 and 116 at the ends of the members 116 nearest the input end 15 of the drum 13*a* to provide a suitable shaping of the veil of aggregate falling across such portion of the drum 13*a* where the flights 104 are mounted. Specifically, the dams 122 give rise to local build-ups of aggregate on the floor of the drum 13*a* to provide localized increases in the veil density for such shaping purposes.

Figure 7:
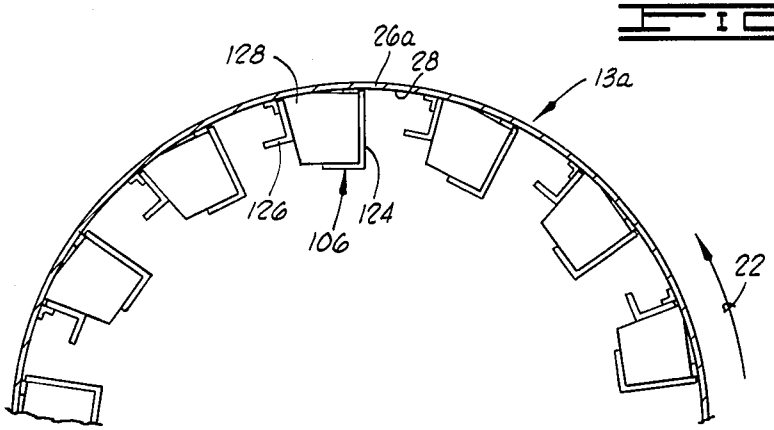
FIG. 7 is a partial transverse cross-section of the drum of FIG. 4 taken along line 7—7 of FIG. 4.

The flights 106 are similar to the flights 104 and the construction of the flights 106 has been shown in FIG. 7. As shown therein, each flight 106 comprises a pair of equal length L-shaped members 124, 126 (see also FIG. 4) mounted on the inner periphery 28 of the shell 26*a* in the same manner and with the same disposition as members 114 and 116 respectively. A dam 128 can be provided between each pair of members 124 and 126, at the end of each flight 106 nearest the input end 15 of the drum 13*a* in the same manner and for the same purpose that the dams 122 are provided for the flights 104.

As is the case with the flights 104 and 106, the flights 108 on the inner periphery 64 of the tubular member 58 of the annular land 30, and the flights 110, on the inner periphery 112 of the tubular member 98 of the annular land 96, are of similar construction. Referring to FIG. 8, each flight 110 preferably comprises a larger member 130 and a relatively smaller, but equal length, member 132 and the members 130 and 132 are substantially equally spaced along the inner periphery 112 of the tubular member 98. Each of the members 130, 132 is bent twice, along substantially parallel longitudinal lines so that the cross section of each of the members 130, 132 approximates a circular arc. The members 130, 132 are mounted on the inner periphery 112 of the tubular member 98 of the annular land 96, via flight mounting members 134 and 136 respectively, in the manner which has been described above and the members 130, 132 are oriented to curve away from the inner periphery 112 of the tubular portion 98 of the annular land 96 generally in the direction 22 in which the drum 13*a* is rotated. The distal ends of each of the members 130, 132 can have serrations formed therein.

Figure 6:
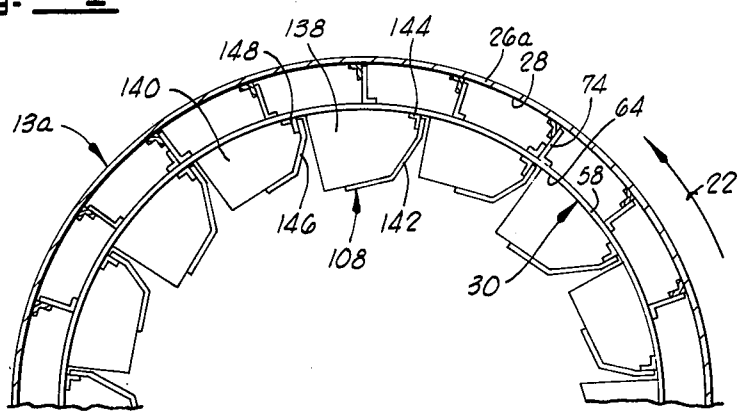
FIG. 6 is a partial transverse cross-section of the drum of FIG. 4 taken along line 6—6 of FIG. 4.

Referring now to FIG. 6, the flights 108 differ from the flights 110 only in that the flights 108 include dams 138 and 140 which are disposed at the ends of the flights 108 nearest the input end 12 of the drum 13*a*. (One of the dams 138 has also been indicated in FIG. 4.) Thus, each of the flights 108 comprises a relatively larger member 142, mounted on the inner periphery 64 of the tubular member 58 of the annular land 30 via a longitudinally extending flight mounting member 144, and a relatively smaller, but equal length, member 146, which is similarly mounted on the inner periphery 64 of the tubular member 58 of the annular land 30 via a longitudinally extending flight mounting member 148. As in the case of the members 130 and 132, the members 142 and 146 are bent such that the cross sections thereof approximate a circular arc extending from the inner periphery 64 of the tubular member 58 in the direction 22 of the rotation of the drum 13*a*. The dams 138 and 140 are particularly useful for further reducing the diameter of the opening of the drum 13*a* through the portion thereof whereon the annular land 30 is mounted so that the veil formed in the drum 13*a* will provide a more efficient obscuration of the opening through the drum 13*a* formed by the annular land 30 so as to provide more efficient reduction of thermal short circuits along the inner periphery of the drum 13.

The provision of two annular lands 30 and 96 in the drum of an asphalt mixing apparatus is particularly useful where, as in the case of the drum 13*a*, means are provided for introducing particulated, previously laid asphalt mix in a medial portion of the drum 13*a*; that is, in portions of the drum 13*a* between the discharge end 14 thereof and portions wherein virgin aggregate is heated and dried. Such particulated, previously laid asphalt mix will include fines which can be entrained in the air stream passing through the drum 13*a* and the annular land 98 provides an additional heavy veil density region near the discharge end 14 of the drum 13*a* to entrap such fines. Moreover, the relative enlargement of the diameter of the inner periphery of the drum 13*a* between the annular land 96 and the discharge end 14 of the drum 13*a* results in a slowing of the air stream near the discharge end of the drum 13*a* to enhance precipitation of fines from the stream of air passing through the drum 13*a* prior to the discharge of the air stream from the discharge end 14 of the drum 13*a*.

Description of FIG. 9

Referring now to FIG. 9, shown therein and designated by the general reference numeral 13*b* is a modification of the drum 13*a* showing another manner of providing a reduced diameter for a portion of the drum of an asphalt mixing apparatus. In particular, the drum 13*b* comprises an input section 150, adjacent the input end 15 of the drum 13*b*, a discharge section 152, adjacent the discharge end 14 of the drum 13*b*, and an intermediate section 154 extending between the input section 150 and the discharge section 154. Each of the sections 150, 152 and 154 are tubular in form and the intermediate section 154 is constructed on a reduced diameter relative to the input section 150 and the discharge section 152. Thus, the input section 150 forms the larger diameter portion of the inner periphery of the drum 13*b* near the input end 15 of the drum 13*b* and portions of the intermediate section 154 provide the reduced diameter portions of the inner periphery of the drum 13*b* which, in the drum 13*a*, are provided by the annular lands 30 and 96. Suitable annular rings, 151 and 153 respectively, connect the input section 150 to the intermediate section 154 and the intermediate section 154 to the discharge section 152 so that the sections 150, 152 and 154 are disposed coaxially about the axis 20 of the drum 13*b*.

The flighting of the drum 13*b* comprises: composite flights 156, which can be identical in construction and placement to the flights 104 of the drum 13*a*; composite flights 158, which can be identical in construction and placement to the flights 108 of the drum 13*a*; composite flights 160, which can be identical in construction and placement to the composite flights 110 of the drum 13*a* and composite flights 162 which can be identical in construction to the composite flights 106 of the drum 13*a*.

Figure 10:
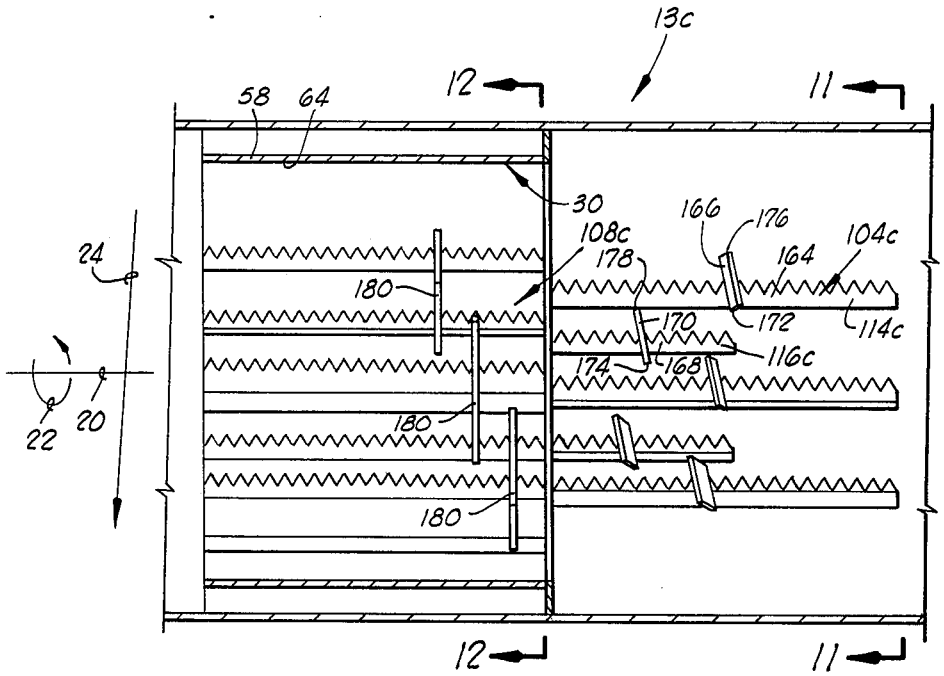
FIG. 10 is a longitudinal cross-section of a portion of the drum shown in FIG. 4 and having modified flighting mounted thereon.
Figure 12:
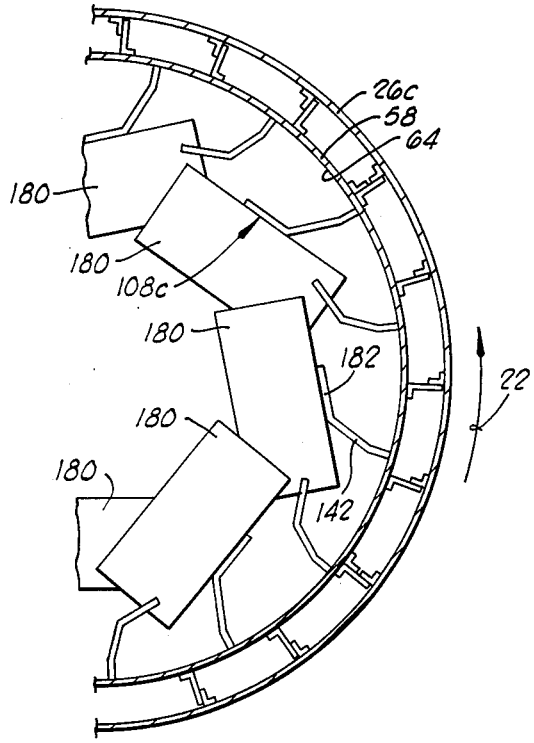
FIG. 12 is a partial transverse cross-section of the drum shown in FIG. 10 taken along line 12—12 of FIG. 10.
Figure 11:
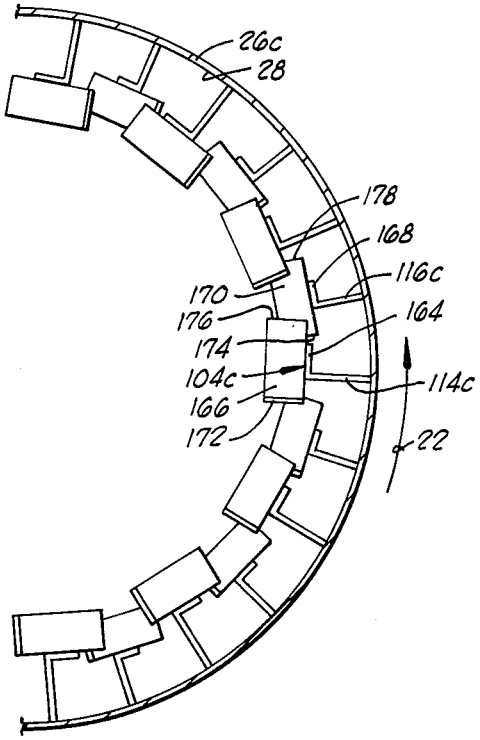
FIG. 11 is a partial transverse cross-section of the drum shown in FIG. 10 taken along line 11—11 of FIG. 10.

Description of FIGS. 10 through 12

Referring now to FIG. 10, shown therein and designated by the numeral 13*c* is a longitudinal cross section of a portion of an asphalt mixing apparatus drum, identical to the drum 13*a*, in which a portion of the flighting mounted on the inner periphery of the drum 13*c* has been modified from the flighting on the drum 13*a* in order to incorporate another mechanism for adjusting the advance rate of aggregate in portions of the drum 13*c* near the input end (not shown in FIG. 10) thereof. Specifically, the portion of the drum 13*c* shown in FIG. 10 encompasses: a portion of the first row of flights from the input end of the drum 13*c*, such flights being designated 104*c* in FIG. 10 and corresponding to the flights 104 in FIG. 4; the annular land 30; and the row of flights mounted on the annular land 30, such flights being designated 108*c* in FIG. 10 and corresponding to the flights 108 in FIG. 4. (As in the previous drawings, only a portion of the row of flights 104*c* and the row of flights 108*c* is shown in FIG. 10 and only one flight 104*c* and one flight 108*c* are numerically designated in FIGS. 10–12.) In order to more clearly show the manner wherein the modified flights 104*c* and 108*c* further adjust the advance rate of aggregate through portions of the drum 13*c* so as to further tailor the veil density of aggregate thereacross, the ascending side of the drum 13*c* has been shown in FIG. 10. That is, the input end of the drum 13*c* is to the right in FIG. 10 and the discharge end thereof is to the left in FIG. 10. Thus, the downward direction for the portion of the drum 13*c* and the direction of rotation thereof during operation of an asphalt mixing apparatus incorporating the drum 13*c* are as have been shown in FIG. 10 and designated, respectively, by the numerals 24 and 22 utilized to indicate such directions in FIGS. 1 through 9.

The flights 104*c*, also shown in FIG. 11, differ from the flights 104 in that the dams 128 have been deleted and two rows of plates have been mounted on the radially innermost portions of the flights 104*c*. (The smaller member 116*c* of the flight 104*c* is also shorter than the corresponding member 116 of the flight 104.) In particular, each of the larger members 114*c* of the flights 104*c* includes, welded to a leg 164 disposed at the distal end thereof and extending generally parallel to the inner periphery 28 of the shell 26*a*, a plate 166 which extends inwardly toward the axis 20 of the drum 13*c* and generally transverse to the axis 20. Similarly, each of the members 116*c* of the flights 104*c* includes, welded to a leg 168 disposed at the distal end thereof and extending generally parallel to the inner periphery 28 of the shell 26*a*, a plate 170 which similarly extends inwardly toward the axis 20 of the drum 13*c* and generally transverse to the axis 20. (Only one of the plates 166 and one of the plates 170 have been numbered in the drawings.) The plates 166 are positioned near the centers of the longitudinal extent of the flights 104*c* and the plates 166 on adjacent flights 104*c* are aligned to form a row extending circumferentially about the inner periphery 28 of the shell 26*a*. Similarly, the plates 170 on adjacent flights 116*c* are aligned to form a row extending about the inner periphery 28 of the shell 26*c* and such row formed by the plates 170 is displaced from the row of plates 166 toward the annular land 30. The angular offset of the members 114*c* and 116*c* along the inner periphery 28 of the shell 26*c* results, as has been shown in FIG. 11, in each of the plates 170 being aligned longitudinally with the spacing between two adjacent plates 166 and the purpose of such spacing will be discussed below. As has been shown in FIG. 10, each of the plates 166 and 170 can be oriented on the flights 104*c* and 116*c* respectively so as to be canted with respect to the axis 20 of the drum 13*c*. In particular, the plates 166 and 170 are positioned so that, on the ascending side of the drum 13*c* shown in FIG. 10, the trailing edges 172 and 174 of the plates 166 and 170 respectively are closer to the input end (not shown) of the drum 13*c* than are the leading edges 176 and 178 respectively thereof.

Similarly, the flights 108*c*, shown in FIGS. 10 and 12, differ from the flights 108 in that dams 138 and 140 have been deleted and each flight 108*c* includes a plate 180 welded to the member 142 of the flight 108*c*. In particular, the plate 180 is welded to a leg 182 of the member 142, said leg 182 being disposed at the distal end of the member 142 and extending generally parallel to the inner periphery 64 of the tubular portion 58 of the annular land 30, and each of the plates 180 is disposed substantially perpendicularly to the axis 20 of the drum 13*c*. As has been shown in FIGS. 10 and 12, the plates 180 on adjacent flights 108*c* are staggered so that the totality of plates 180 form a generally spiral structure extending entirely about the inner periphery of the portion of the drum 13*c* where the annular land 30 is formed. Moreover, as shown in FIG. 12, the plates 180 are selected to be of a size such that each end of each plate 180 is overlapped by one end of another plate 180.

The plates 166, 170 and 180 reduce the advance rate of aggregate through portions of the drum 13*c* where the plates 166, 170 and 180 are disposed, so as to increase the veil density in such portions by superimposing upon the general transport of aggregate toward the discharge end of the drum 13*c* a reverse transport toward the input end of the drum 13*c*. Specifically, as aggregate falls from a flight 104*c* or 108*c* on the ascending side of the drum 13*c*, a portion of such aggregate will strike the side of a plate 166, 170 or 180, mounted on a lower flight, 104*c* or 108*c* respectively, such side being the side of the plate 166 or 180 disposed nearest the input end of the drum 13*c*, and will be deflected from such plate 166, 170 or 180 toward the input end of the drum 13c. The superimposed reverse transport can be adjusted both by varying the sizes of the plates 166, 170 and 180 and by canting the plates in the manner shown for the plates 166 and 170. That is, the quantity of aggregate impinging on one of the plates 166, 170 or 180 at any time depends upon the area of projection of such plate on a plane normal to the direction 24 in which the aggregate falls and such area of projection depends both on the size of the area being projected; that is, the area of the plate, and the angle between the normal to the plate and the direction 24. While such angle will change as the drum rotates, the average value of such angle on the ascending side of the drum 13c will increase as a plate 166, 170 or 180 is canted such that the trailing edge of such plate is nearer the input end of the drum 13c than is the leading edge of such plate where the drum 13c is disposed on a slant such that the discharge end thereof is lower than the input end thereof.

The sizes and arrangements of the plates 166, 170 and 180 in FIGS. 10 through 12 has been selected to generally accomplish a slightly larger veil density in the portion of the drum 13c where the flights 104c are mounted than would be the case for the corresponding portion of the drum 13a where the flights 104 are mounted and a considerably larger veil density in the portion of the drum 13c where the annular land 30 is disposed than the corresponding portion of the drum 13a. In particular, the plates 166, 170 are of relatively small area while the plates 180 are provided with a much larger area. The plates 166, 170 can be canted, as shown in FIG. 10, to further adjust the net advance rate of aggregate through the portion of the drum 13c where such plates 166, 170 are mounted.

Such an arrangement of the plates 166, 170 and 180 is particularly useful in cases in which a large ratio of particulated, previously laid asphalt mix to virgin aggregate is used in the production of fresh asphalt. In such case, the transport rate of virgin aggregate through portions of the drum 14c in which drying of virgin aggregate takes place is reduced so that a lower advance rate of virgin aggregate, to achieve a veil density in such portions of the drum 13c corresponding to a higher transport rate of virgin aggregate, is desirable both for reducing thermal short circuits along the inner periphery of the drum 13c and for protecting the particulated, previously laid asphalt from excessive heating which might result in burning of asphaltic oil contained in the particulated, previously laid asphalt. The positioning of the plates 170 behind gaps formed between adjacent plates 166 provides an annular barrier which intercepts such air streams and diverts air flowing along the inner periphery of the drum 13c generally toward the axis 20 of the drum 13c. The overlap of the plates 180 forces air moving along the periphery 64 of the tubular portion 58 of the annular land 30 into a vortical motion which substantially increases the distance that air must travel along the periphery 64 of such tubular portion 58 to reach the discharge end of the drum 13c. The result is a greater resistance to air flow along the periphery 64 of the tubular portion 58 of the annular land 30 than through central portions of the drum 13c with a resultant increase in the proportion of air which moves through the veil of aggregate across the portion of the drum 13c where the annular land 30 is formed. It will be noted that such reduction of thermal short circuits as well as an increase in the veil density, can be formed by plates similar to the plates 166, 170 and 180 disposed in portions of the drum 13c other than at portions where the annular land 30 is located.

It is clear that the present invention is well adapted to carry out the objects and attain the ends and advantages mentioned as well as those inherent therein. While presently preferred embodiments of the invention have been described for purposes of the disclosure, numerous changes may be made which will readily suggest themselves to those skilled in the art and which are encompassed within the spirit of the invention disclosed and as defined in the appended claims.

What is claimed is:

1. In an apparatus for producing hot mix asphalt from aggregate and asphaltic oil in a rotating drum mixer having an input end higher than the discharge end thereof, said apparatus having flighting arranged in rows about the inner periphery of the drum for lifting and dropping aggregate introduced into the input end of the drum in a veil across the drum so as to transport the aggregate toward the discharge end of the drum, the improvement wherein:

a portion of the inner periphery of the drum near the input end thereof and supporting at least one row of said flighting is formed on a relatively large diameter; and a portion of the inner periphery of the drum, adjacent said large diameter portion and disposed between said large diameter portion and the discharge end of the drum, is formed on a smaller diameter than said large diameter portion, said smaller diameter portion of the inner periphery of the drum supporting at least one row of said flighting; and wherein the drum is further characterized as comprising:

a cylindrical shell;

a plurality of radially inwardly extending standoffs mounted on and circumferentially spaced about a portion of the inner periphery of the shell; and an annular land mounted within such shell a selected distance from the input end of the drum, a portion of the inner periphery of the shell forming the large diameter portion of the inner periphery of the drum and the annular land forming the smaller diameter portion of the inner periphery of the drum; the annular land comprising:

a tubular member having a circular outer periphery engaged and supported in a concentric disposition with the shell by said stand-offs;

means on the outer periphery of the tubular member for engaging selected stand-offs so as to prevent relative rotation of the shell and said tubular member during operation of the apparatus for mixing hot mix asphalt; and a ring disposed across the spacing between the shell and the tubular member at the end of the annular land nearest the input end of the drum.

2. The apparatus of claim 1 wherein both ends of the annular land are axially supported in the drum by engagement between said ends of the annular land and a row of flighting on the inner periphery of said shell.

3. In an apparatus for producing hot mix asphalt from aggregate and asphaltic oil in a rotating drum mixer having an input end higher than the discharge end thereof, said apparatus having flighting arranged in rows about the inner periphery of the drum for lifting and dropping aggregate introduced into the input end of the drum in a veil across the drum so as to transport the aggregate toward the discharge end of the drum, the improvement wherein:

a portion of the inner periphery of the drum near the input end thereof and supporting at least one row of said flighting is formed on a relatively large diameter; and a portion of the inner periphery of the drum, adjacent said large diameter portion and disposed between said large diameter portion and the discharge end of the drum, is formed on a smaller diameter than said large diameter portion, such smaller diameter portion of the inner periphery of the drum supporting at least one row of said flighting;

wherein the drum is further characterized as comprising:

a cylindrical shell; and an annular land mounted within such shell a selected distance from the input end of the drum, a portion of the inner periphery of the shell forming the large diameter portion of the inner periphery of the drum and the annular land forming the smaller diameter portion of the inner periphery of the drum; and wherein the asphaltic oil is introduced into the drum between the annular land and the discharge end of the drum; wherein the flighting includes at least one row of flighting on the inner periphery of the cylindrical shell between said annular land and the discharge end of the drum; and wherein the drum further comprises a second annular land mounted on portions of the inner periphery of the shell between the location where asphaltic oil is introduced into the drum and the discharge end of the drum, said second annular land supporting at least one row of flighting utilized for lifting and dropping asphalt across the drum.

4. The apparatus of claim 3 further comprising means for introducing particulated, previously laid asphalt into the drum between said two annular lands.

5. The apparatus of claim 3 or claim 4 wherein the drum comprises a plurality of stand-offs mounted on the inner periphery of the shell, a portion of the stand-offs circumferentially spaced about one portion of the inner periphery of the shell and a portion of the stand-offs circumferentially spaced about one other portion of the inner periphery of the shell axially displaced from said one portion of the inner periphery of the shell; wherein each annular land comprises:

a tubular member having a circular outer periphery engaged and supported in a concentric disposition with the shell by the stand-offs mounted on one of said portions of the inner periphery of the shell;

means on the outer periphery of the tubular member for engaging selected stand-offs so as to prevent relative rotation of the shell and said tubular member during operation of the apparatus for mixing hot mix asphalt; and a ring disposed across the spacing between the shell and the tubular member at the end of the annular land nearest the input end of the drum; and wherein the drum further comprises stop means for axially supporting at least one end of each annular land in the drum.

6. The apparatus of claim 5 wherein the stop means supports one end of each of the annular lands and wherein the other end of each of the annular lands is axially supported in the drum by a row of flighting mounted on the inner periphery of said shell.

7. In an apparatus for producing hot mix asphalt in a rotating drum disposed on a slant with an input end thereof higher than an opposed discharge end thereof, said apparatus including means for introducing aggregate into the input end of the drum, means for receiving asphalt from the discharge end of the drum, means for introducing a flame into the input end of the drum, means for introducing asphaltic oil into a medial portion of the drum, and flighting arranged in rows about the inner periphery of the drum for lifting and dropping aggregate and asphalt in a veil across the drum so as to transport the aggregate and asphalt toward the discharge end of the drum, an improved drum comprising:

a cylindrical shell extending between the input end of the drum and the discharge end thereof; and means forming an annular land on the inner periphery of said shell between the input end thereof and the medial portion of the drum where asphaltic oil is introduced into the drum, wherein at least one row of said flighting is carried by portions of the inner periphery of said shell between the means forming the annular land and the input end of the drum and at least one row of flighting is carried by the means forming the annular land.

8. The drum of claim 7 further comprising means forming one other annular land on the inner periphery of said shell between the medial portion of the drum where asphaltic oil is introduced into the drum and the discharge end of the drum, the means forming said one other annular land carrying at least one row of said flighting.

9. The drum of claim 8 wherein a plurality of ports are formed through said shell between said annular lands and wherein the asphalt mixing apparatus further comprises means for introducing particulated, previously laid asphalt mix into the drum via said ports.

* * * * *